US005389947A

United States Patent [19]

Wood et al.

[11] Patent Number: 5,389,947

[45] Date of Patent: Feb. 14, 1995

[54] CIRCUITRY AND METHOD FOR HIGH VISIBILITY CURSOR GENERATION IN A GRAPHICS DISPLAY

[75] Inventors: Paul B. Wood, Spring; Thomas M. Albers, Houston; Stephen B. Preston, Spring, all of Tex.

[73] Assignee: Compaq Computer Corporation, Houston, Tex.

[21] Appl. No.: 26,207

[22] Filed: Mar. 2, 1993

Related U.S. Application Data

[63] Continuation of Ser. No. 696,355, May 6, 1991, abandoned.

[51] Int. Cl.[6] ..... G09G 1/28

[52] U.S. Cl. ..... 345/145; 345/114; 345/153

[58] Field of Search ..... 340/703, 701, 709, 724, 340/732, 721, 723, 747, 798; 345/157, 902, 145, 146, 114, 150, 162, 113, 153

[56] References Cited

U.S. PATENT DOCUMENTS

| | | | |
|---|---|---|---|
| Re. 31,200 | 4/1983 | Sukonick et al. | 340/724 |
| 4,467,322 | 8/1984 | Bell et al. | 340/703 |
| 4,626,835 | 12/1986 | Nienaber et al. | 340/703 |
| 4,668,947 | 5/1987 | Clarke, Jr. et al. | 340/709 |
| 4,808,989 | 2/1989 | Tabata et al. | 340/798 |
| 4,835,526 | 5/1989 | Ishii et al. | 340/703 |
| 5,140,312 | 8/1992 | Ishii | 340/703 |
| 5,146,211 | 9/1992 | Adams et al. | 345/145 |
| 5,185,597 | 2/1993 | Pappas et al. | 345/145 |

OTHER PUBLICATIONS

Hamacher et al., *Computer Organization* (McGraw-Hill, 1978), pp. 432 and 434.

*Product Selection Guide* (Brooktree Corporation, 1991), pp. 11, 13, 14, 16.

*Primary Examiner*—Tommy P. Chin
*Assistant Examiner*—A. Au
*Attorney, Agent, or Firm*—Vinson & Elkins

[57] ABSTRACT

A graphics subsystem, including a video digital-to-analog converter, is disclosed. A high speed oscillator generates a pixel clock signal at the frequency at which pixels are to be displayed. Included in the video DAC is a frequency divider which presents an output clock signal having a period which is a multiple of the pixel clock signal, the multiple corresponding to the level of multiplexing of pixel data to be provided by the video DAC; this multiple can equal unity. The video controller in the system receives the output clock signal, and generates clock signals to control the serial port of the frame memory, and also to control the latching of the first stage in the video DAC. The first stage latch in the video DAC latches in the multiple pixel data from the frame memory, and the multiplexer in the video DAC presents the data to the color palette RAM, or around the color palette RAM in true-color non-multiplexed mode, according to the pixel clock signal. Highlighted pixels in a cursor are displayed by inverting the output of the color palette RAM at cursor locations, for example by way of an exclusive-OR function of the color palette RAM output and a bit corresponding to the comparison of the display location and the desired cursor location. Inversion of the output of the color palette RAM results in higher contrast pixels within the cursor.

15 Claims, 3 Drawing Sheets

CIRCUITRY AND METHOD FOR HIGH VISIBILITY CURSOR GENERATION IN A GRAPHICS DISPLAY

This is a continuation of application Ser. No. 07/696,355, filed May 6, 1991, now abandoned.

This invention is in the field of data processing equipment, and is more specifically directed to circuitry for generating a video display image.

This application is related to application Ser. No. 695,963, filed contemporaneously herewith and assigned to Compaq Computer Corporation.

BACKGROUND OF THE INVENTION

High resolution video displays are becoming more prevalent for modern data processing systems such as personal computer workstations and the like. As is well known, video displays achieve such higher resolution by increasing the density of picture elements ("pixels") within the screen area. Higher pixel density correlates to smaller pixel sizes, such that the resolution of the displayed image is increased. As a result, the display output of the workstation may be more accurate and lifelike, presenting the output of the computer or workstation in more useful and illustrative forms to the user.

As is well known not only in the art, but also to any user of modern personal computers and workstations, a cursor is a block of pixels for indicating a particular location in the display area. Cursors are generally used to indicate the "location" at which an input is desired from the user. When used in conjunction with a displayed image, such as a graphics image, the location of the cursor in the image communicates to the user the context of the desired input. The cursor must contrast with its surroundings to be visible when located within a displayed image. The displayed cursor may consist of an entire pixel block contrasting with the surroundings, such that a rectangular block appears at the pixel location. Alternatively, the cursor may be a character or other displayed image which is contained within the cursor block, for example an arrow or other icon, with bits outside of the cursor image within the cursor block appearing as though the cursor were not present. Timing features may also be included in cursor generation, for example by causing the cursor to blink on the display, further contrasting it with the surroundings.

When the display technology is purely monochromatic, as is the case with older and lower-end computer products, the generation of a cursor image which contrasts with its surroundings is relatively easy, as only two colors need be considered. U.S. Pat. No. Re. 31,200, reissued Apr. 5, 1983, describes the generation of a cursor in a monochromatic display at column 21, lines 30 through 38, where control memories provide inputs to logic which develops synchronized pulses mixed with the video data for display of a cursor.

In recent years, however, many advanced personal computers and workstations use a large number of colors and patterns to display graphics images. In such polychromatic systems, the generation of the cursor image in such a manner as to provide high visibility is a more complicated task, because multiple bits of data are necessary to communicate the color and attributes of each pixel in the displayed image. Generation of a contrasting cursor thus requires consideration of a multiple-bit word which may not be directly representative of the image displayed.

For example, conventional polychromatic display systems use color palette memories in generating the graphics image. As is well known in the art, color palette RAMs are addressable memories which, for each addressable location, store digital data corresponding to the color and intensity for the pixel to be displayed. As such, the color palette RAM is a look-up table, such that the bit-mapped graphics data stored in the frame memory of the system consists of a series of color palette RAM addresses, or indices, for each pixel in the image. The image is generated by presenting the data for each pixel as an address to the color palette RAM; the color palette RAM will then present the addressed contents to a digital-to-analog converter to drive the display device accordingly. The actual colors displayed thus depend not only on the graphics data stored in the frame memory (upon which graphics instructions and other processes have been performed by the system processors), but also upon the contents of the color palette RAM.

The generation of a cursor in such a system is thus further complicated by the use of the color palette RAM and the indexed mode of color selection. A first prior technique for cursor generation is the storage of a limited set of cursor colors (e.g., two or three) in a portion of the color palette; at such pixel locations at which the cursor is to be displayed, the cursor color is generated from the cursor portion of the palette, rather than from the color palette RAM itself. This method may not necessarily present a contrasting cursor, however, as the cursor color is not selected considering the surrounding image, or considering the color which would be presented if the cursor were not enabled.

A second prior method for cursor generation in such systems is to logically invert the pixel data presented to the color palette RAM, i.e., the color index. This method uses the data of the pixel which would otherwise be displayed if the cursor were not displayed in determining the cursor color. As such, a contrasting cursor color is more likely than if a color is merely selected without regard to the pixel data. However, the cursor color in this method depends upon the contents of the color palette RAM. Only by careful design of the color palette RAM contents, such that complementary indices generate contrasting colors, can a contrasting cursor be guaranteed. Failing such efforts, the cursor color will be substantially random according to this method.

By way of further background, the above-cited U.S. Patent describes the use of an exclusive-OR function to generate a contrasting color for a pixel. Attention is directed to column 12, lines 25 through 40, and to column 13, line 23 through column 14, line 18, for discussion of the XOR feature in a line-drawing and erasing context for a monochromatic display system. Column 26, line 48 through column 27, line 39, describes a color display system by analogy.

It is therefore an object of this invention to provide a graphics display system which generates a cursor image having a high likelihood that it will significantly contrast with its surroundings.

It is a further object of this invention to provide such a system which is particularly useful in a color display system.

It is a further object of this invention to provide such a system which may be used in conjunction with a color palette RAM.

It is a further object of this invention to provide such a system which may be used in a high resolution display environment.

It is a further object of this invention to provide such a system which may operate upon pixel data which is either a color index value, or a color component intensity value.

Other objects and advantages of the invention will be apparent to those of ordinary skill in the art having reference to the following specification together with the drawings.

SUMMARY OF THE INVENTION

The invention may be incorporated into a graphics sub-system including frame memory and a video digital-to-analog converter (VDAC). The VDAC includes circuitry for generating display data for driving the display device, for example by way of DACs. An example of the circuitry for generating display data is a color palette RAM; alternatively, the display data may be directly provided from the frame memory. In either case, the display data corresponds to the intensity of the components (e.g., RGB) of the image for each pixel. Cursor generation hardware is included which inverts the display data at cursor locations. As a result, the contrast between the cursor image and its surroundings is increased, improving cursor visibility.

Figure 2:
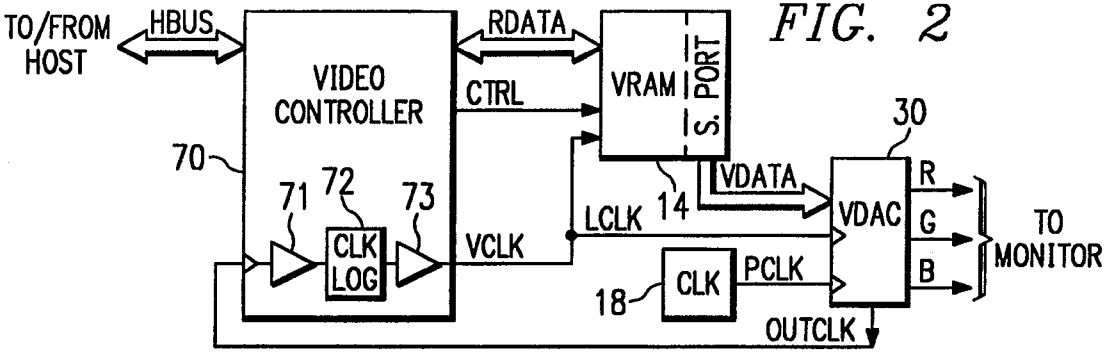
FIG. 2 an electrical diagram, in block form, of a system according to the present invention including the video DAC of FIG. 1.

FIGS. *3a* and *3b* are timing diagrams illustrating the operation of the system of FIG. 2 in multiplexed mode and non-multiplexed mode, respectively.

Figure 1:
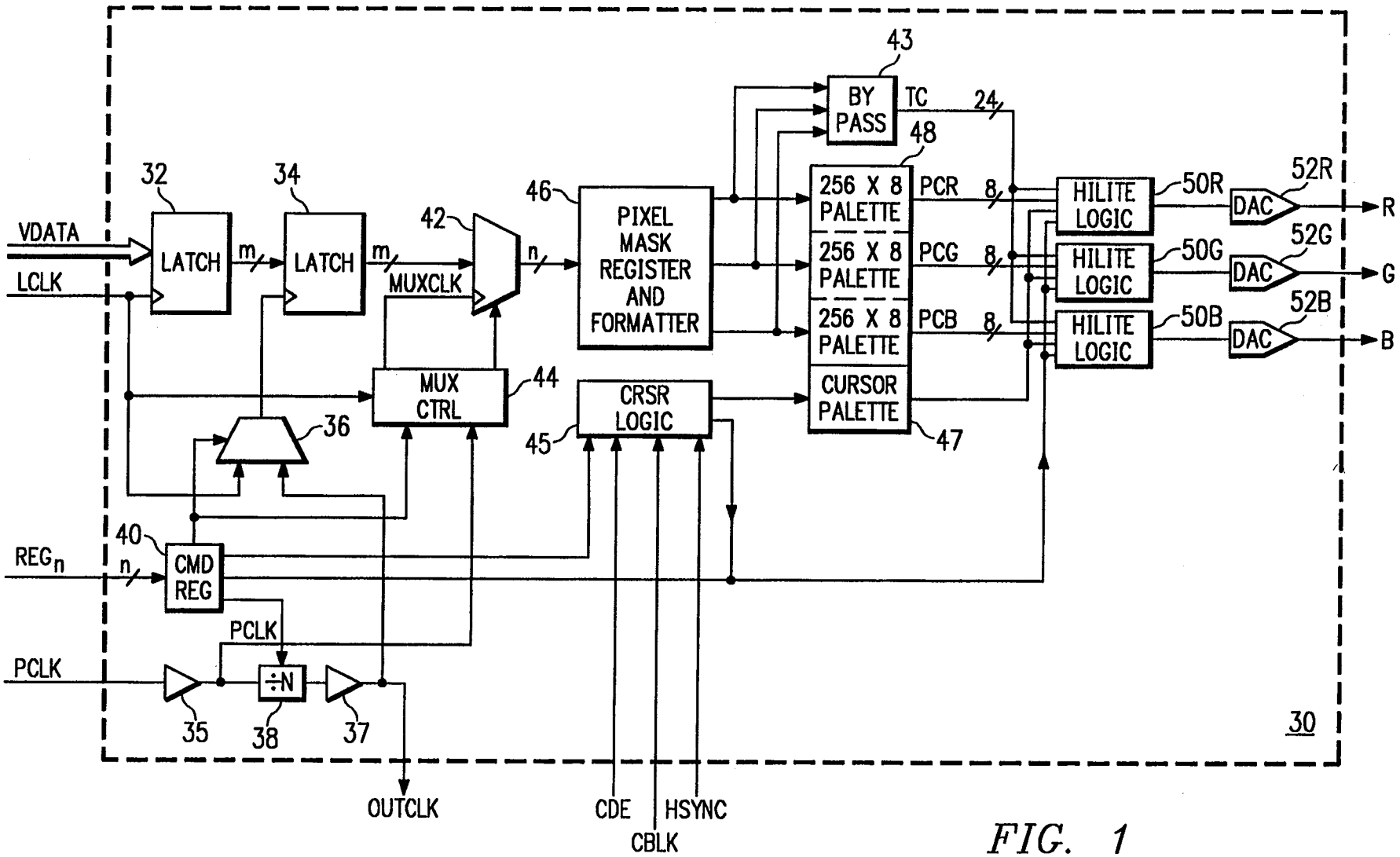
FIG. 1 is an electrical diagram, in block form, of a video DAC according to the present invention.
Figure 4:
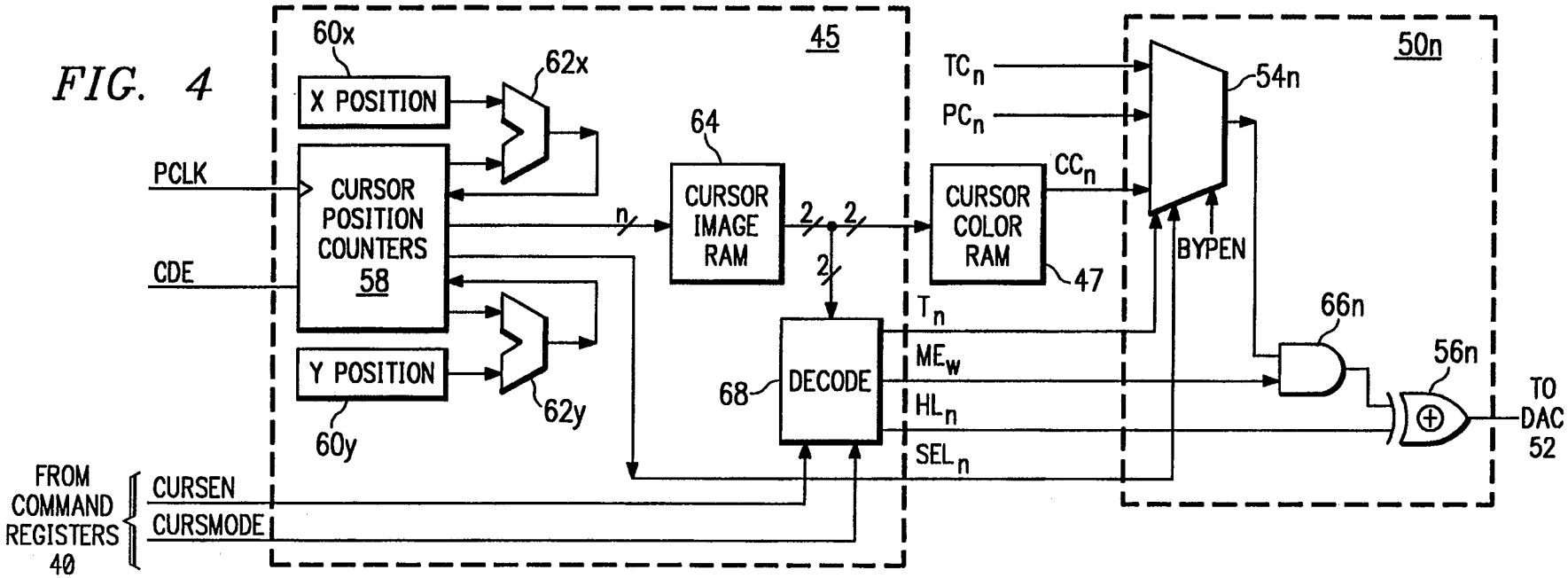

FIG. 4 is an electrical diagram, in block schematic form, of the cursor logic in the video DAC of FIG. 1.

Figure 5:
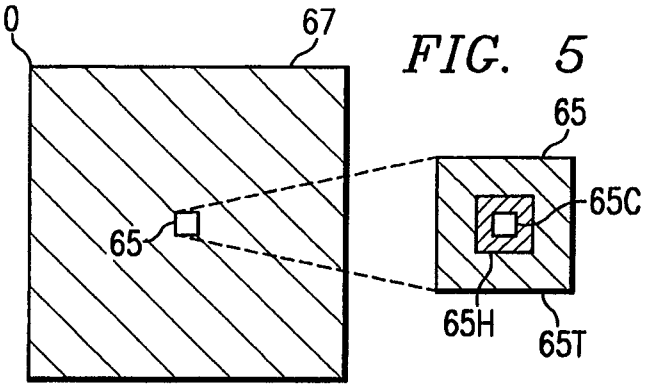

FIG. 5 a representation of the display driven by the system of FIG. 2, including the position of a cursor therein.

DETAILED DESCRIPTION OF THE PREFERRED EMBODIMENT

Referring now to FIG. 1, VDAC 30 according to the preferred embodiment of the invention will now be described in detail. VDAC 30 is a multiplexed video DAC, preferably formed as a single integrated circuit, and including color palette RAM, hardware cursor, and other functions useful in the generation of analog RGB signals corresponding to digital pixel data supplied thereto.

As will be apparent from the following description, according to this embodiment of the invention, the clocking of the input latch is performed independently from the multiplexing and output of video data according to the high-speed pixel clock signal. Due to this separate clocking, the pixel clock frequency is not limited by the propagation delay of the output clock signal OUTCLK elsewhere in the graphics subsystem. Higher speed system operation is thus achieved, so that higher density displays can be driven according to the present invention.

VDAC 30 includes first stage latch 32 having an input for receiving digital data from bus VDATA. Another terminal of VDAC 30 receives a clock signal LCLK from external to VDAC 30. Clock signal LCLK is received by first stage latch 32 to control the latching of data therein. Bus VDATA communicates pixel data from frame memory to the display driver; in this example, bus VDATA includes at least thirty-two lines upon which thirty-two bits of graphics data are communicated to VDAC 30. As will be described in detail hereinbelow, these thirty-two bits can represent eight, four, two or one pixel for display, depending upon the number of colors desired. It should also be noted that, for systems such as the well-known VGA configuration, eight additional lines may be provided in bus VDATA for display in so-called "VGA" mode; if such is the case, a port select signal may also be presented to first stage latch 32 for selection of the "port" corresponding to the thirty-two pixel data lines or the eight-line VGA text port.

Pixel clock signal PCLK is also received at a terminal of VDAC 30 from an off-chip clock source, such as a phase-locked loop or oscillator, and is coupled to divide-by-N circuit 38 via buffer 35. Divide-by-N circuit 38 is controlled by command register 40 to set the multiple N by which the frequency of pixel clock signal PCLK is to be divided. In this example, N may be selected from the values 1, 2, 4, or 8, corresponding to the level of multiplexing in VDAC 30 (i.e., the number of pixels received at a time from bus VDATA). Buffer 37 receives the output of divide-by-N circuit 38, and drives clock signal OUTCLK at a terminal of VDAC 30.

According to this embodiment of the invention, and as will be described hereinbelow relative to the operation of VDAC 30, the clock signal received at LCLK controls the receipt of pixel data by VDAC 30 (in first stage latch 32), rather than the output clock signal OUTCLK controlling such receipt as used in prior conventional VDACs. In such prior systems, the use of the output clock signal OUTCLK to latch video data into the VDAC required that the propagation delay, access time and setup time all occur within one cycle of the output clock signal OUTCLK, which limited the video data rate through the VDAC. This limitation is overcome in this embodiment of the invention.

High speed pixel clock signal PCLK controls the application of the pixel data to the "back-end" processing of VDAC 30, including the digital-to-analog conversion for driving the display device. For proper operation, however, synchronization of the pixel data received by VDAC 30 to the pixel clock signal PCLK is necessary. In this example, such synchronization is implemented by way of second stage latch 34, having an input coupled to the output of first stage latch 32 in a master-slave configuration (latch 32 being the master and latch 34 the slave). The clocking of data into second stage latch 34 is controlled by clock multiplexer 36, in this example, due to the different operating modes desired for VDAC 30. Clock multiplexer 36 receives pixel clock signal PCLK at one input and output clock signal OUTCLK at a second input. Clock multiplexer 36 selects either clock signal LCLK or clock signal OUTCLK for application to the clock input of second stage latch 34, under control of command registers 40, according to the multiplexing mode selected for VDAC 30.

Command registers 40 are loaded by signals on bus REGn, presented by a video controller or other circuit in the system. The contents of command registers 40 control the selection of 8:1, 4:1, 2:1, or 1:1 multiplexing, as well as other modes of operation for VDAC 30 including hardware cursor mode selection and control.

The various multiplexing modes selectable for VDAC 30 allow it to drive display devices of various sizes and resolution by selecting the desired mode. As a result, neither substitution of a different video DAC nor reconfiguration of the system hardware is necessary to efficiently drive different displays. In this embodiment, the multiple of the pixel clock PCLK frequency which is applied to the second stage latch 36 is selected by command registers 40 corresponds to the desired level of multiplexing.

The output of second stage latch 34 is connected to the input of multiplexer 42. Multiplexer 42 is controlled by multiplexer control circuit 44, which receives information indicative of the level of multiplexing desired from command registers 40. Multiplexer control circuit 44 also receives pixel clock signal PCLK after buffering by buffer 35, and applies it to multiplexer 42 via line MUXCLK, phase shifted by a desired amount consistent with delay through latches 32 and 34, as necessary. Multiplexer control circuit 42 also receives latch clock signal LCLK at an input, which it will apply to line MUXCLK in non-multiplexed mode, as will be described hereinbelow. Multiplexer 42 provides j bits at its output, j being determined by the multiplexing level desired, and indicated by command registers 40 and multiplexer control circuit 44. In this embodiment of the invention, where 8:1, 4:1, 2:1, and 1:1 multiplexing is available, j may equal 4, 8, 16 or 24 bits (24 being sufficient for "true color" output for a pixel and selected in non-multiplexed mode).

It should be noted that the above-described arrangement of master-slave latches 32, 34 is only one contemplated implementation of circuitry for synchronizing the pixel data to the pixel clock signal PCLK. Such synchronization may also be implemented with a single latch stage 32, by inserting a fixed phase relationship between pixel clock signal PCLK (as applied to multiplexer 42 on line MUXCLK) relative to clock signal LCLK (i.e., relative to the output clock signal OUTCLK generated from pixel clock signal PCLK). Proper timing between latch clock signal LCLK and multiplexer clock MUXCLK, when based on pixel clock signal PCLK, will allow such synchronization without requiring two latches. Further in the alternative, a FIFO buffer may alternatively be used, with the input of such a buffer coupled to the output of first stage latch 32, and with its contents shifted according to pixel clock signal PCLK. It is now contemplated that other synchronization circuits and techniques for accomplishing this function will now also be apparent to those of ordinary skill in the art having reference to this description.

The output of multiplexer 42 is applied to the input of processor 46. Processor 46 includes such conventional functions as a pixel mask register for masking pixel data in the conventional fashion; in addition, processor 46 can provide a formatting function, either by way of a look-up table or by logical operation, to receive the pixel data from multiplexer 42 for proper application to color palette RAM 48, the input of which receives the output of processor 46. Processor 46 may, in addition, be capable of performing graphics operations on the data that it receives from multiplexer 42, such operations including color processing.

In conventional display systems, the data communicated from the frame memory for a pixel is generally a color index. This color index corresponds to an address in color palette RAM 48, which serves as a color look-up table. In this embodiment of the invention, color palette RAM 48 stores 256 displayable color combinations, each being twenty-four bits wide. Color palette RAM 48 generates the twenty-four bit output addressed by the color index presented to its input. Eight bits of the twenty-four bit output correspond to the desired intensity for the red portion of the RGB analog output, eight bits for green, and eight bits for blue. The combination of the intensities for the three "guns" of the RGB monitor corresponds to the desired display color. In VDAC 30 according to this embodiment of the invention, the three sets of eight-bit outputs from color palette RAM 48 are applied to eight-bit inputs of highlight logic 50R, 50G, 50B, respectively.

For communication of true color information in non-multiplexed mode, where up to twenty-four bits are used for each pixel, the communicated from multiplexer 42 to color palette RAM 48 are grouped according to the display components driven by VDAC 30, and correspond to the intensity level of each component to be driven to the display device. In this example where the display device is a CRT, driven by RGB (red-green-blue) components, twenty-four bits from multiplexer 42 include eight intensity bits for the red component, eight intensity bits for the green component, and eight intensity bits for the blue component. As a result, the data communicated for each pixel is not limited to the 256 colors in color palette RAM 48, but directly communicates the eight-bit digital value corresponding to the intensities of the red, green and blue guns of the monitor. Accordingly, each gun can receive 256 intensity values from the frame memory, thus allowing generation of $256^3$, or 16,777,216 possible colors from the twenty-four bits of information. Alternatively, fewer bits (for example sixteen bits, grouped as five-six-five for the three color components) may be used to communicate the intensity of each component to be driven to the display device.

It should be noted that this true color data could be communicated directly to DACs 52, so that the analog intensity output therefrom would be a direct digital-to-analog conversion of the pixel data from frame memory 14. Color palette RAM 48 preferably assists in the accuracy of the displayed color, however, by providing a look-up function for each of the three components of pixel data it receives. According to this preferred embodiment, as shown in FIG. 1, color palette RAM 48 is segmented into three 256 by 8 portions, and includes three address decoders, each independently operating on a group of bits from multiplexer 42 in the true color mode. The segmented contents provide an output for each component (e.g., RGB) which corresponds to an intensity value designated by the pixel data presented thereto in the associated group of input bits. Use of the color palette RAM 48 in this mode allows for adjustment of the linearity of the analog output generated by each digital value; this adjustment may be done considering the responsive of a particular display device to be driven by VDAC 30, or according to other characteristics of the system.

It should also be noted that a portion, or mode, of color palette RAM is also preferably available by which it considers the output of processor 46 not as three separate eight-bit addresses, but considers it as a twenty-four bit address. In this mode, controlled for example by control registers 40, color palette RAM 48 operates as a 256 by 24 memory device, rather than as a set of three 256 by 8 memory segments. It is contemplated that a designer of ordinary skill in the art will be able to readily construct such a segmented memory, based on this specification.

There is also a need to communicate pixel data directly to DACs 52 without correction by color palette RAM 48. Accordingly, VDAC 30 further includes bypass logic 43 which, under control of command registers 40, couples the output of processor 46 to highlight logic 50 when an alternative display mode is selected, for example a VGA display mode, or other modes in which use of color palette RAM 48 is not desired. When enabled, bypass logic 43 communicates the output of processor 46 to the three sets of eight-bit inputs to highlight logic 50R, 50G, 50B.

Highlight logic 50R, 50G, 50R, have eight-bit outputs connected to the inputs of digital-to-analog converters (DACs) 52R, 52G, 52B, respectively. DACs 52R, 52G, 52B generate analog values corresponding to the digital value at their inputs in conventional DAC fashion; these analog values are communicated to the system monitor, and drive the corresponding red, green and blue electron guns in the monitor. While the present invention is described for conventional RGB display systems, other types of monitors and display systems may also benefit from the present invention.

VDAC 30 also includes both a conventional hardware cursor function, as well as a highlight mode function according to the preferred embodiment of the invention. As is well known, a cursor is a block of pixels, for example thirty-two pixels on a side in a high density display, which contrasts with and is displayed instead of the graphical output at a location of the screen, for example corresponding to a location at which a user input is requested. The displayed cursor may consist of the entire pixel block contrasting with the surroundings, such that a rectangular block appears at the pixel location. Alternatively, the cursor may be a character or other displayed image which is contained within the cursor block, for example an arrow or other icon, with bits outside of the cursor image within the cursor block appearing as though the cursor were not present. Timing features may also be included in cursor generation, for example by causing the cursor to blink on the display, further contrasting it with the surroundings.

As illustrated in FIG. 1, VDAC 30 includes certain elements which are conventional for generation of a cursor. These elements include cursor color RAM 47, selectable by way of cursor logic 45 under control of command registers 40. Cursor logic 45 includes a cursor image RAM which communicates a cursor color selection to cursor color RAM 47 at times corresponding to the pixel within the cursor block. Cursor color RAM 47 in turn presents the selected cursor color on the twenty-four output lines coupled to highlight logic 50 for application to DACs 52.

Other prior cursor display systems perform an exclusive-OR function between a cursor on value ("1") and the video data; in these prior display systems, however, the exclusive-OR function is done on the color index value, i.e., the input to color palette RAM 48. Because this prior arrangement results in a cursor color index value which is the logical complement of the non-cursor value, the contrast in colors depends upon the arrangement of colors in the color palette RAM, particularly the difference in colors having complementary index values. If similar colors have complementary index values, the displayed cursor may not significantly contrast with the surrounding color, and have poor visibility relative to its surroundings.

According to the present invention, however, a highlight cursor mode may be selected by a value loaded into command registers 40. In this mode, for those pixels within the cursor area which are to be "highlighted", the output from color palette RAM 48, or from bypass logic 43, depending on the mode, is logically inverted prior to application to DACs 52. As a result, it is much more likely that the displayed cursor will significantly contrast with the color which would otherwise be displayed (and thus with the surrounding colors, as it is likely that the surrounding colors are similar), than in prior cursor highlight implementations where the color index value was inverted to highlight pixels in the cursor.

According to the present invention, VDAC 30 includes a highlight mode, generated by highlight logic 50R, 50G, 50B, which ensures that the cursor color contrasts as much as possible with the color it is replacing in the display. Referring now to FIG. 4, highlight logic **50*n* for one bit will be described in detail in combination with cursor logic 45**.

Cursor logic 45 includes cursor image RAM 64, as noted hereinabove. Cursor image RAM 64 includes an addressable location for each pixel within the desired cursor block. For example, if the size of the displayed cursor block is 32 pixels by 32 pixels, cursor image RAM will have $32^2$ addressable locations. Each addressable location in cursor image RAM 64 consists of a digital code corresponding to the image to be displayed for that pixel. For example, for simple cursor generation schemes, cursor image RAM 45 would have one bit of storage for each address, with the value of the bit corresponding to "on" or "off" for that pixel in the cursor. In the present embodiment, cursor image RAM 64 is 32 by 32 by 2, with four modes selectable for each pixel in the cursor block; these four modes are "color 1", "color 2", "transparent" and "highlight", which will be described hereinbelow.

Cursor logic 45 further includes X and Y position registers **60*x* and 60*y*, respectively, for storing the X and Y coordinates of the desired position of the cursor in the displayed image. As will be noted hereinbelow, the stored value in registers 60 will be one corner of the cursor image, for example the lower right hand corner. Cursor logic 45 further includes cursor position counters 58, having both X and Y components therein, for keeping track of the current pixel position being displayed. Cursor position counters 58** receive a reset signal on line CDE which, as is well known, is the composite display enable signal indicating the beginning of the display area, and also receive pixel clock signal PCLK for incrementing its contents for each pixel displayed.

Comparators **62*x*, 62*y* are also located within cursor logic 45, for comparing the contents of cursor position counters 58 with the values stored in X and Y position registers 60*x* and 60*y*. The output of comparators 62*x*, 62*y* is communicated to cursor position counters 58. The output of cursor position counters 58 is an address value communicated to cursor image RAM 64, presenting either an address which corresponds to a null value when the current pixel being displayed is outside of the cursor block, or which corresponds to the position of the current pixel within the pixel block when such is the case. Cursor position counters 58 also present a control signal on line SELn to highlight logic 50**, for controlling the selection of a cursor color data for pixels located within the cursor block, as will be further noted hereinbelow.

Cursor image RAM 64, in this example, presents a two-bit value (RAM 64 having two bits per address) to cursor color, or palette, RAM 47, and to decoder 68. As noted hereinabove, the contents of cursor image RAM 64 indicates the desired display mode for a pixel in the cursor block. Two of the modes available in this example of the invention correspond to two pre-assigned colors, color 1 and color 2. Cursor palette RAM 47 is thus addressable by the output of cursor image RAM 45 to present the selected color (color 1 or color 2) to highlight logic 50.

Decoder 68 also receives the output of cursor image RAM 64, and controls the transparent and highlight modes according to this embodiment of the invention. Decoder 68 receives signals on lines CURSEN and CURSMODE from command registers 40, indicating whether the cursor function is to be enabled, and the modes available for display of the cursor; command registers 40 thus can disable the generation of any cursor (or particular cursor modes) by these signals. Decoder 68, in this example, presents control signals to highlight logic 50 on lines ME and HL.

Referring still to FIG. 4, a single bit 50*n* of highlight logic 50 is illustrated; it is of course understood that each of the twenty-four bits of highlight logic 50 will be similarly constructed. Included within highlight logic 50*n* is multiplexer 54*n*, which receives line TCn from bypass logic 43, line PCn from color palette RAM 48, and line CCn from cursor color RAM 47. Multiplexer 54*n* also receives control inputs on line SELn from decoder 68 in cursor logic 45, and on line BYPEN from command registers 40. In addition, decoder 68 generates a line Tn, for transparent mode, which is also connected to a control input of multiplexer 54*n* so that, in a cursor location when transparent or highlight cursor pixels are to be displayed, multiplexer 54*n* will not select line CCn. Multiplexer 54*n* is thus able to select one of the three inputs for application to its output, dependent upon whether or not bypass logic 43 is enabled, and depending upon whether or not the current pixel is within the cursor block, or is to be transparent or highlighted.

The output of multiplexer 54*n* is coupled to an input of AND gate 66*n*, which receives line MEn from decoder 68 in cursor logic 45. The output of AND gate 66*n* is coupled to a first input of exclusive-OR gate 56*n*, which receives line HLn from decoder 68 at its other input. The output of exclusive-OR 56n is connected to its associated DAC 52.

The operation of cursor logic 45 and highlight logic bit 50*n* will now be described relative to FIG. 5. FIG. 5 illustrates display area 67, having its origin 0 in the upper left-hand corner; for purposes of this example, it is assumed that the entire display area 67 is of the same color. Cursor block 65 is illustrated as near the center of the display area in this example. For purposes of description, this example of the desired image for cursor block 65 is an area 65C of "color 1" at its center, surrounded by a highlighted area 65H, further surrounded by a "transparent" area 65T, in which the color which would otherwise be displayed will appear (the cursor being transparent in area 65T).

In operation, display area 67 will be generated for each pixel outside of cursor 65, by color palette RAM 48 presenting the display color to highlight logic 50 on lines PCn (as shown in FIG. 4), beginning from origin O when line CDE resets the values in cursor position counters 58. Prior to this time, the desired cursor position values have been loaded into cursor position registers 60*x*, 60*y*. As the display data is generated, so long as the pixel position is outside of cursor 65, the result of comparators 62*x*, 62*y* will indicate the same to cursor position counters 58. The null value will be communicated to cursor image RAM 64, and accordingly to decoder 68. In addition, line SELn will indicate to multiplexer 54*n* to not select line CCn for output; either line PCn from color palette RAM 48 or line TCn from bypass logic 43 will be applied to the output of multiplexer 54*n* for these locations, depending upon the state of line BYPEN. For pixels outside of cursor 65, decoder 68 will also drive line MEn high and line HLn low, so that the output of multiplexer 54*n* is communicated to DAC 52.

As display area 67 is scanned, pixel clock signal PCLK increments cursor position counters 58 until such time as cursor 65 is reached, and indicated by comparators 62*x*, 62*y*. Cursor position counters 58 will then present an address value to cursor image RAM 64, within which is stored the image shown in the blown-up portion of FIG. 5.

For those pixels within color area 65C, the output of cursor image RAM 64 will communicate the value to cursor palette RAM 47 which will address color 1 for application on line CCn to multiplexer 54*n*. Cursor position counters 58 will also indicate to multiplexer 54*n*, by way of line SELn, that line CCn is to be selected for application to its output, and to AND gate 66. This result will also cause decoder 68 to drive line MEn high and line HLn low, so that the output of multiplexer 54*n*, which is cursor color 1 data on line CCn, is to be applied to DAC 52 for pixels in area 65C. It should be noted that other pre-assigned cursor colors will be similarly generated.

For pixels within transparent area 65T, however, the output of cursor image RAM 64 will present a code which causes decoder 68 to indicate on line Tn that a transparent pixel is to be generated. Line Tn will override the state of line SELn from cursor position counters 58, and cause the otherwise selected line PCn or TCn to be applied to the output of multiplexer 54*n*, as though the pixel were not within cursor 65. Lines MEn and HLn are held high and low, respectively, so that the state of the output of multiplexer 54*n* will be communicated directly to DAC 52.

Within highlighted area 65H according to the invention, cursor image RAM 64 will indicate to decoder 68 that the highlight function is to be applied. In this mode, decoder 68 will drive line Tn to multiplexer 54*n* so that the otherwise selected line PCn or TCn is applied to the output of multiplexer 54*n*, as though the pixel were not within cursor 65. In addition, decoder 68 will drive both lines MEn and HLn to high states. This will cause the output of multiplexer 54*n* to be applied to exclusive-OR gate 56*n*, but will cause exclusive-OR gate 56*n* to invert the value of multiplexer 54*n* prior to its application to DAC 52. As a result, for pixels in area 65H, the color displayed will be generated from DACs 52 from the logical complement of the color that would otherwise be displayed were the pixel not within cursor 65.

According to this embodiment of the invention, the exclusive-OR function of highlight logic 50, controlled according to the comparison of the display location to the desired cursor location and the desired cursor image, presents the logical complement of the digital color value as the cursor color, rather than the logical complement of the color index value as used in conventional video DACs and systems. The cursor contrast according to the present invention is therefore improved over a larger set of colors, and is not dependent upon the organization of colors within color palette RAM 48, according to this embodiment of the invention.

Referring still to FIG. 4, it should be noted that other cursor modes are available. For example, decoder 68 may drive line MEn low, forcing the output of AND gate 66*n* low regardless of the output of multiplexer 54*n*. The state of line HLn will then determine whether a "1" or a "0" is applied to DAC 52 for that bit. As a result, a forced color (e.g., pure white, or pure black) can be generated for pixels in the cursor, without requiring the color to be stored in cursor palette 47.

Referring now to FIG. 2, the implementation of VDAC 30 into a graphics subsystem, and its operation in connection therewith, will now be described. The system includes a video controller 70 which is connected via host bus HBUS to a host processor (not shown). Video controller 70 is also connected to VRAM 14 via random access bus RDATA and control lines CTRL, for controlling access to and refresh of VRAM 14. VRAM 14 is a dual-port memory subsystem, preferably including multiple video DRAM devices as are readily available, each video DRAM device having a random access port for communication via bus RDATA to video controller 70, and also a serial access port for output of data to VDAC 30 on bus VDATA. The serial output from VRAM 14 is controlled by clock signal VCLK generated by video controller 70.

Video controller 70 may be a microprocessor, including graphics-specific microprocessors such as the TMS 34020 manufactured and sold by Texas Instruments Incorporated. Alternatively, and preferably for many high volume graphics subsystems, video controller 70 may be a custom integrated circuit, such as an ASIC, constructed to perform the particular graphics functions and operations desired. Via buffer 71, clock logic 72 in video controller 70 receives a output clock signal OUTCLK from VDAC 30, generates clock signal VCLK for application to VRAM 14 and clock signal LCLK for application to VDAC 30, both driven by buffer 73. As noted above, clock signal VCLK controls the output of serial data from the serial port of VRAM 14. Clock logic 72 includes the necessary and desired delay and other circuitry for generating clock signal LCLK at the appropriate phase delay from clock signal OUTCLK for system optimization. In this example, clock signals LCLK and VCLK are phase synchronous since they are generated at the same terminal of video controller 70; clock signals LCLK and VCLK may be alternatively be separately generated from clock signal OUTCLK, and may have a phase difference.

In this example, clock signal LCLK is also connected to the LCLK input of VDAC 30 which, as shown in FIG. 1, controls the latching of data from bus VDATA into first stage latch 32 of VDAC 30. Also as noted hereinabove, clock source 18 (for example, a PLL or oscillator) provides pixel clock signal PCLK to VDAC 30; pixel clock signal PCLK is at the frequency at which pixels of data are to be applied to the monitor receiving the analog output of VDAC 30. This frequency depends upon the refresh rate of the monitor (e.g., 60 Hz), and the display size in number of pixels. For example, if the display size is 1024 by 768 pixels, the frequency of pixel clock signal PCLK must be at least 47 MHz in order for each pixel to be displayed within the refresh time. It is contemplated that the present invention will be applicable to pixel clock signal PCLK frequencies at least as high as 80 to 100 MHz.

Figure 3A:
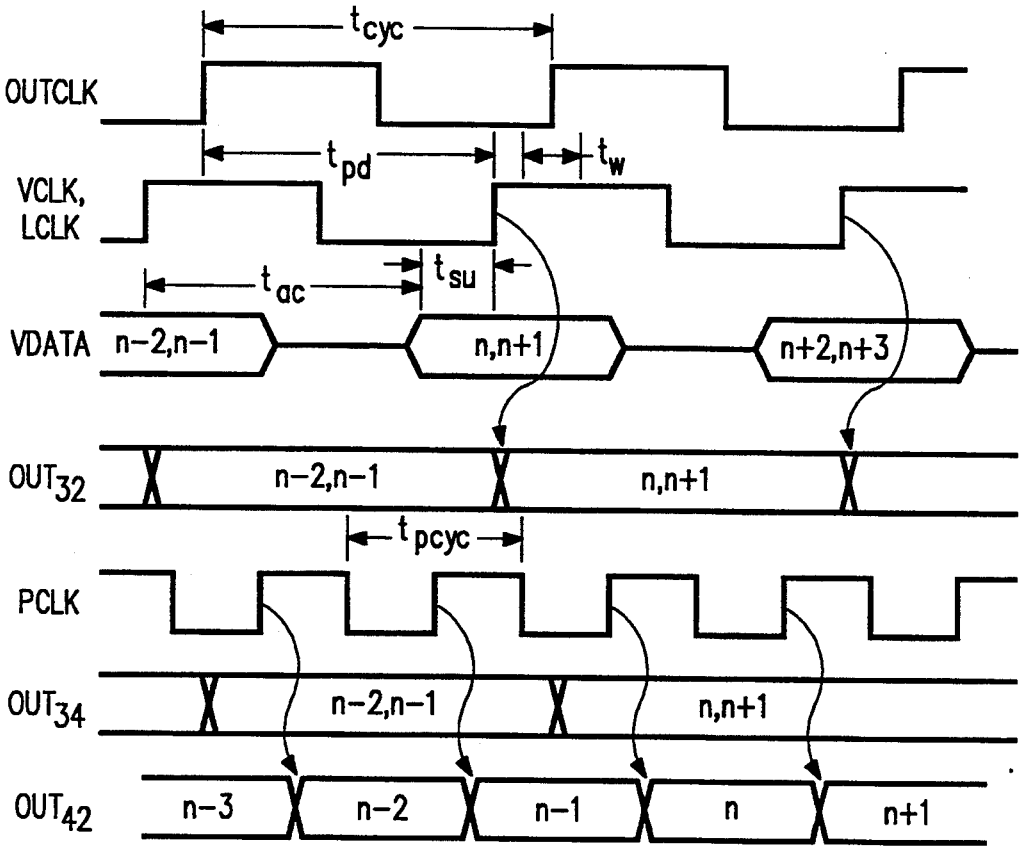

Referring now to FIG. 3*a*, the operation of VDAC 30 in the system of FIG. 2 will now be described in detail, relative to a 2:1 multiplexed mode. As noted hereinabove, the multiplexing modes available in VDAC 30 according to this embodiment of the invention include 8:1, 4:1, 2:1, and 1:1 (or non-multiplexed mode); for ease of description, the 2:1 multiplexed mode will be described relative to FIG. 3*a*.

Pixel clock signal PCLK from high speed oscillator 18 is applied to divide-by-N circuit 38 to produce output clock signal OUTCLK. In this example of the 2:1 multiplexing mode, command register 40 contains the appropriate code for 2:1 multiplexing, and controls divide-by-N circuit 38 to produce clock signal OUTCLK at twice the period of pixel clock signal PCLK (i.e., N equals 2). It should be noted that, according to the present invention, the phase relationship between pixel clock signal PCLK and clock signal OUTCLK is not important.

Clock signal OUTCLK is communicated to video processor 70 which, via buffers 71, 73 and clock logic 72, generates clock signals VCLK for application to VRAM 14, and LCLK for application to VDAC 30. As noted hereinabove, clock signal VCLK controls the serial port of VRAM 14 and, accordingly, a serial access of VRAM 14 commences upon each rising edge of clock signal VCLK. After the access time $t_{ac}$ from the rising edge of clock signal VCLK, data will be presented on bus VDATA from the serial port of VRAM 14.

According to this example, clock signals VCLK and LCLK are generated at the same terminal of video processor 70, and hence not only have the same frequency as one another (and as output clock signal OUTCLK from which they are generated), but are also phase synchronous with one another (with neither one phase synchronous with output clock signal OUTCLK). As noted hereinabove, it is not necessary for clock signals VCLK and LCLK to be phase synchronous, but use of the same output terminal of video processor 70 is preferred for convenience. Common clock signals VCLK and LCLK require, however, that access time $t_{ac}$ from VRAM 14 is short enough that data is presented on bus VDATA prior to the necessary setup time $t_{su}$ before the next rising edge of clock signal LCLK, as this rising edge latches the data on bus VDATA into first stage latch 32 of VDAC 30. Of course, if the access time $t_{ac}$ is not that fast, generation by video processor 70 of a separate clock signal LCLK, delayed in phase from clock signal VCLK, would allow for proper operation of the system.

As noted hereinabove, the rising edge of clock signal LCLK latches the video data on bus VDATA from VRAM 14 into latch 32 of VDAC 30. After a short propagation delay, the latched data appears at the output of first stage latch 32, shown as line $OUT_{32}$ in FIG. 3*a*. Referring to FIG. 3*a*, such operation is evident where pixels n, n+1 are accessed from the first rising edge of clock signal VCLK, and appear at least as early as access time $t_{ac}$ thereafter. The next rising edge of clock signal LCLK after this access latches data for pixels n, n+1 into first stage latch 32, and presents the data at the output of first stage latch 32 (line $OUT_{32}$) after a short propagation delay.

Command registers 40 contain the code to enable 2:1 multiplexing in VDAC 30 in this example, and thus communicate to clock multiplexer 36 that clock signal OUTCLK is to control the latching of second stage latch 34 (instead of clock signal LCLK as will be used in the non-multiplexed mode described hereinbelow). Accordingly, upon the next rising edge of clock signal OUTCLK, second stage latch 34 receives and stores the output of first stage latch 32, and presents this data at its output after propagation through second stage latch 34. FIG. 3*a* illustrates this latching by line $OUT_{34}$ presenting pixels n, n+1 shortly after the first rising edge of clock signal OUTCLK after data for pixels n, n+1 has appeared at line $OUT_{32}$.

As noted hereinabove, the synchronization of the pixel data received by VDAC 30 and latched into first stage latch 32 is accomplished by way of the master-slave configuration of first and second stage latches 32, 34. Using this latch configuration, proper control of the phase relationship between clock signals OUTCLK and LCLK is important to ensure proper operation during multiplexed mode. This is due to the requirement that the data at the output of first stage latch 32 must be stable prior to the next rising edge of clock signal OUTCLK (as applied to second stage latch 34), which latches this data into second stage latch 34. Accordingly, setup and hold times of the data at the output of first stage latch 32 relative to the rising edge of clock signal OUTCLK must be obeyed for reliable operation. Referring to FIG. 3*a*, this is illustrated by time window $t_w$ on either side of the rising edge of clock signal OUTCLK, during which no transition of clock signal LCLK is allowed. Since in this case the rising edge of clock signal LCLK precedes time window tw, the data for pixels n, n+1 is safely at the input of second stage latch 34 prior to the rising edge of clock signal OUTCLK.

It should be noted that this timing window will not be a significant limitation in the design and operation of VDAC 30, and thus the relatively easy implementation of second stage latch 34 to achieve synchronization is preferred in this embodiment. Alternative synchronization techniques, such as controlling the internal phase relationship between the high speed pixel clock signal and the latch clock signal, will not present this limitation on the system timing, and may thus be advantageous in some cases.

Command registers 40 also control multiplexer control circuit 44 to cause multiplexer 42 to select the appropriate bits at its input for application at its output. In the 2:1 multiplexing mode, with thirty-two bits presented at the output of second stage latch 34, sixteen bits will be selected by multiplexer 42 responsive to each rising edge of pixel clock signal PCLK. Therefore, upon the first rising edge of pixel clock signal PCLK after data for pixels n, n+1 appear at the output of second stage latch 34, multiplexer 42 applies the data for pixel n at its output (shown as line $OUT_{42}$ in FIG. 3*a*). Upon the next rising edge of pixel clock signal PCLK thereafter, data for pixel n+1 will be selected by multiplexer 42 and presented at its output.

As discussed hereinabove, in multiplexed mode the output of multiplexer 42 will be applied, via processor 46 in the conventional manner, to color palette RAM 48. The output of color palette RAM 48 corresponding to the pixel data presented thereto will then be passed through highlight logic 50 (assuming no cursor at this location), for application to DACs 52 and control of the monitor. It should be noted that the delays of the pixel data through this back-end processing in VDAC 30 are easily accounted for in synchronizing the operation of VDAC 30 with the monitor; in effect, a certain amount of "pipelining" is present within the data path of VDAC 30 between first stage latch 32 and the analog RGB output.

As a result of this operation in multiplexed mode, it should be noted that significant cycle time limitations of prior systems are overcome. Particularly, it should be noted that the propagation delay $t_{pd}$ between corresponding edges of clock signal OUTCLK and clock signals VCLK and LCLK is no longer a factor in the operation of the system. This is due primarily to the decoupling of clock signal OUTCLK from first stage latch 32, and to the additional stage of pipelining within VDAC 30. In the system of FIG. 2, the following relationship must be maintained:

$$t_{cyc} \geqq t_{ac} + t_{su}$$

with $$N(t_{pcyc}) = t_{cyc}$$

where N is the multiplexing coefficient. For example, if N equals 2, with $t_{ac}$ on the order of 25 nsec, and $t_{su}$ on the order of 4 nsec, $t_{pcyc}$ must be only 14.5 nsec or greater in order for the system to operate. Removal of the propagation delay time through video controller 70 thus greatly improves the data rate of VDAC 30 compared to prior configurations.

Figure 3B:
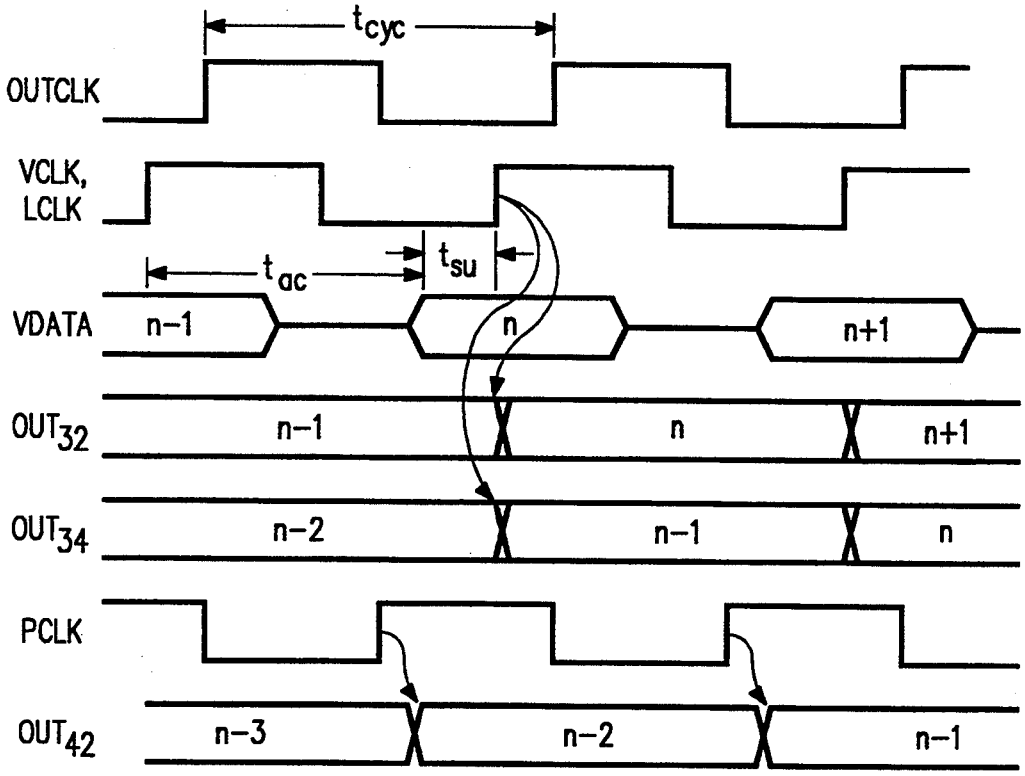

This improvement in the data rate, which allows for a faster $t_{pcyc}$ to be used, enables non-multiplexed modes, such as twenty-four bit true color mode, to be used with relatively high density displays. As described hereinabove relative to its construction VDAC 30 allows for such a non-multiplexed (or 1:1 multiplexed) mode. Referring now to FIG. 3*b*, the operation of such a mode will now be described.

As in the case of the multiplexed mode, VDAC 30 receives pixel clock signal PCLK from high speed oscillator 18, and generates clock signal OUTCLK therefrom by way of divide-by-N circuit 38. In this mode, however, command registers 40 control divide-by-N circuit such that clock signal OUTCLK is at the same frequency as pixel clock signal PCLK (i.e., N equals 1). Also as in the prior case, video processor 70 receives clock signal OUTCLK and generates clock signals VCLK and LCLK therefrom. Responsive to the rising edge of clock signal VCLK, the serial port of VRAM 14 will present pixel data on bus VDATA, at least as early as the access time $t_{as}$ thereof. In this mode, however, each pixel is represented by twenty-four bits, in three groups of eight bits representative of the desired intensity for each of the red, green and blue guns in the CRT monitor. Accordingly, data for only one pixel is obtained by each access of the serial port of VRAM 14 in this mode.

Upon the next rising edge of clock signal LCLK after data for a pixel (e.g., pixel n) appears on bus VDATA, first stage latch 32 will latch in the pixel data. In this non-multiplexed mode, command registers 40 control clock multiplexer 36 to select clock signal LCLK to also control the latching of second stage latch 34, so that the prior contents of first stage latch 32 are latched into second stage latch 34, in master-slave fashion. Accordingly, upon the next rising edge of clock signal LCLK after data for pixel n appears on bus VDATA, first stage latch 32 stores and presents data for pixel n, and second stage latch 34 stores and presents data for pixel n−1 (the prior contents of first stage latch 32 in non-multiplexed mode). The outputs of latches 32 and 34 are shown in FIG. 3*b* relative to lines $OUT_{32}$ and $OUT_{34}$, respectively.

Command registers 40 also indicate to multiplexer control circuit 44 that non-multiplexed mode is enabled. As a result, all twenty-four bits communicated to the input of multiplexer 42 are presented at its output responsive to each rising edge of clock signal LCLK, which multiplexer control circuit 44 selects for application to line MUXCLK to multiplexer 42. Upon the first rising edge of clock signal MUXCLK after second stage latch 34 has latched in the data for pixel n−1, multiplexer 42 will present this data for pixel n−1 at its output. Upon completion of the next successive clock cycle of clock signal MUXCLK (and clock signals OUTCLK and LCLK), data for pixel n will appear at the output of multiplexer 42.

Also in non-multiplexed mode, color palette RAM 48 operates in a segmented fashion, so that it considers the output of multiplexer 42 in groups of eight bits (for example), each group presenting a digital intensity value for a corresponding DAC 52. The output of color palette RAM 48, corresponding to an adjusted intensity value depending upon the particularly display system, is communicated to highlight logic 50. True color data stored in and presented by VRAM 14 to VDAC 30 is thus converted by DACs 52 to the proper analog form for application to the display device.

Similarly as in the example described hereinabove relative to FIG. 3*a*, the cycle time $t_{cyc}$ (which is the same as the cycle time of pixel clock signal PCLK, and clock signal LCLK) does not include the propagation delay through video processor 70. As a result, using the same access times as noted hereinabove for the example of FIG. 3*a*, the pixel clock rate for the non-multiplexed mode need be 34 nsec or greater in order to allow for the access and setup times of the system. True color data can thus be driven to a relatively high density display (on the order of 700 pixels on a side) by this embodiment of the invention, even where the access and setup times are modest.

While the invention has been described herein relative to its preferred embodiment, it is of course contemplated that modifications of, and alternatives to, this embodiment, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A video display driver circuit, comprising:

a color palette memory for storing intensity data corresponding to the intensity of display components, said color palette memory having an input for receiving an address value, and having an output at which it presents pixel data in a digital form including a value having a magnitude corresponding to the intensity of at least one color component to be displayed, responsive to the address value received at its input;

inverting circuitry, having a data input coupled to the output of said color palette memory, and having a control input and an output, said inverting circuitry for inverting the output of said color palette memory responsive to a control signal received at its control input;

a cursor enable circuit coupled to the control input of said inverting circuitry, for generating said control signal responsive to a display location being at a selected cursor location in a displayed image; and output circuitry, having an input coupled to the output of said inverting circuitry, for presenting, to a display device, an output signal corresponding to the inverted output of the color palette memory.

2. The circuit of claim 1, wherein said inverting circuitory comprises:

an exclusive-OR function having a first input coupled to the output of said color palette memory, and having a second input for receiving said control signal.

3. The circuit of claim 1, further comprising:

bypass logic, having an input coupled to the input of said color palette memory and having an output coupled to said inverting circuitry;

mode select circuitry, for selecting between first and second modes; and a multiplexer, having data inputs coupled to the output of said bypass logic and to the output of said color palette memory, having an output, said multiplexer also having a control input coupled to said mode select circuitry, said multiplexer for communicating the output of said bypass logic to its output in said first mode, and for communicating the output of said color palette memory to its output in said second mode;

and wherein the output of said multiplexer is coupled to the input of said inverting circuitry.

4. The circuit of claim 3, wherein said inverting circuitry comprises:

an exclusive-OR function having a first input coupled to the output of said multiplexer, and having a second input for receiving said control signal.

5. The circuit of claim 1, wherein said output circuitry comprises:

a digital-to-analog converter, for converting the output signal corresponding to the inverted output of the color palette memory into analog form to drive the display device with the displayed image.

6. The circuit of claim 1, wherein said pixel data includes a plurality of values, each value having a magnitude corresponding to the intensity of a color component to be displayed so that said pixel data corresponds to a plurality of color components;

and wherein said output circuitry comprises:

a plurality of digital-to-analog converters, each for converting a portion of the inverted output of the color palette memory corresponding to one of the plurality of values into analog form to drive the display device with the corresponding color component of the displayed image.

7. The circuit of claim 6, wherein said color palette memory stores intensity data corresponding to the intensity of a plurality of display components, each display component associated with one of said plurality of digital-to-analog converters.

8. The circuit of claim 1, wherein said cursor enable circuitry comprises:

a counter for storing a value corresponding to the display location;

a register for storing a value corresponding to the location of the cursor in the displayed image;

a comparator for comparing the contents of the counter to the contents of the register; and an image circuit, for storing a cursor image and for generating said control signal responsive to said comparator indicating that said display location matches the value in said register and responsive to said display location corresponding to a highlighted pixel in said cursor image.

9. The circuit of claim 8, wherein said image circuit comprises:

an image memory for storing a code corresponding to each location in the image of said cursor; and a decorder, for receiving the stored code from said image memory and for generating said control signal responsive to said code.

10. A data processing apparatus, comprising:

a frame memory for storing a color index value for each of a plurality of locations in an image to be displayed;

a color palette memory, coupled to said frame memory, for storing intensity data corresponding to the intensity of display components, said color palette memory addressable by color index values from said frame memory to present, at an output, pixel data of a digital form including a value having a magnitude corresponding to the intensity of at least one color component to be displayed;

inverting circuitry, for inverting pixel data presented at the output of said color palette memory responsive to a cursor control signal;

a cursor enable circuit coupled to said inverting circuitry, for generating said cursor control signal responsive to a current display location corresponding to a cursor location in a displayed image; and output circuitry, coupled to said inverting circuitry, for presenting, to a display device, a signal corresponding to the inverted pixel data.

11. The system of claim 10, wherein said pixel data comprises first, second and third values having a magnitude corresponding to the intensity of first, second and third color components to be displayed, respectively;

and wherein said output circuitry comprises:

first, second and third digital-to-analog converters, each for receiving first, second and third portions of the output of said color palette memory corresponding to the first, second and third color values, respectively, each digital-to-analog converter for converting said pixel data to an analog signal corresponding to the intensity of its associated display color.

12. The system of claim 10, wherein said inverting circuitry comprises:

an exclusive-OR function having a first input coupled to the output of said color palette memory, and having a second input for receiving said cursor control signal.

13. The system of claim 10, further comprising:

a video processor, coupled to said frame memory, for accessing said frame memory and for storing data therein corresponding to an image to be displayed;

a host processor, coupled to said video processor by way of a host bus; and a display device, coupled to said output circuitry.

14. A method of generating a cursor in a displayed image, comprising the steps of:

storing an image in a frame memory, in the form of a plurality of pixel memory locations, each corresponding to a pixel in a display image, each pixel memory location containing a digital color index value;

retrieving, from a plurality of pixel memory locations in said frame memory, the color index values corresponding to a portion of said display image;

addressing a color palette memory with each of said retrieved color index values to generate image data for each pixel in the corresponding portion of the display image, said color palette memory storing said image data in digital form including a value having a magnitude corresponding to the intensity of a color component to be displayed;

determining whether or not each pixel in the corresponding portion of the display corresponds to a highlighted cursor location in said display image;

for each pixel corresponding to a cursor location, inverting the image data associated therewith; and applying said inverted image data to a display device.

15. The method of claim 14, wherein said inverting step comprises:

generating the logical complement of said image data for those pixels corresponding to a cursor location.

* * * * *